US009842676B2

(12) United States Patent
Tada et al.

(10) Patent No.: US 9,842,676 B2
(45) Date of Patent: Dec. 12, 2017

(54) SURGE ABSORBING ELEMENT

(71) Applicant: Mitsubishi Electric Corporation, Tokyo (JP)

(72) Inventors: Kiyokazu Tada, Tokyo (JP); Manabu Ohashi, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 0 days.

(21) Appl. No.: 15/312,813

(22) PCT Filed: May 23, 2014

(86) PCT No.: PCT/JP2014/063743

§ 371 (c)(1),
(2) Date: Nov. 21, 2016

(87) PCT Pub. No.: WO2015/177931

PCT Pub. Date: Nov. 26, 2015

(65) Prior Publication Data

US 2017/0140854 A1 May 18, 2017

(51) Int. Cl.
*G08B 21/00* (2006.01)
*H01C 7/12* (2006.01)
(Continued)

(52) U.S. Cl.
CPC ..... *H01C 7/12* (2013.01); *G08B 21/185* (2013.01); *H01C 1/14* (2013.01)

(58) Field of Classification Search
None
See application file for complete search history.

(56) References Cited

U.S. PATENT DOCUMENTS 4,047,143 A 9/1977 Burden et al.
2011/0188161 A1* 8/2011 Feichtinger ..... H01C 7/10 361/52

(Continued)

FOREIGN PATENT DOCUMENTS

JP 50-135939 U 11/1975
JP 54-90650 U 6/1979

(Continued)

OTHER PUBLICATIONS

JPO Office Action for Application No. 2015-524551 dated Jun. 30, 2015.

(Continued)

*Primary Examiner* — Julie Lieu
(74) *Attorney, Agent, or Firm* — Sughrue Mion, PLLC; Richard C Turner

(57) ABSTRACT

A surge absorbing element includes a varistor substrate, a pair of electrodes that are electrically connected to both end faces of the varistor substrate, respectively, to sandwich the varistor substrate, external leads that electrically connect to the paired electrodes, respectively, exterior members that cover the electrodes, and a thermal expansion body that is provided between the paired electrodes and that irreversibly expands with heat generated by the varistor substrate to separate at least one of the paired electrodes from the varistor substrate. A temperature at which the thermal expansion body starts expanding is, for example, equal to or higher than 180° C.

8 Claims, 3 Drawing Sheets

(51) Int. Cl.
*H01C 1/14* (2006.01)
*G08B 21/18* (2006.01)

(56) References Cited

U.S. PATENT DOCUMENTS

| | | | | |
|---|---|---|---|---|
| 2011/0194222 | A1* | 8/2011 | Durth | H01T 1/12 361/91.1 |
| 2011/0261536 | A1* | 10/2011 | Feichtinger | H01C 1/084 361/713 |
| 2012/0229246 | A1* | 9/2012 | Depping | H01C 7/12 337/114 |
| 2012/0268850 | A1* | 10/2012 | Rainer | H01T 1/15 361/56 |
| 2015/0364281 | A1* | 12/2015 | Depping | H01C 7/12 337/326 |
| 2016/0087687 | A1* | 3/2016 | Kesler | H04B 5/0037 307/104 |

FOREIGN PATENT DOCUMENTS

| | | | |
|---|---|---|---|
| JP | 63-6701 | U | 1/1988 |
| JP | 1-86202 | U | 6/1989 |
| JP | 3149085 | U | 3/2009 |
| JP | 2011-77234 | A | 4/2011 |
| JP | 2013-529855 | A | 7/2013 |

OTHER PUBLICATIONS

Office Action for Application No. 104111204 dated Mar. 24, 2016.
Office Action for Application No. 104111204 dated Aug. 30, 2016.
International Search Report for PCT/JP2014/063743 dated Aug. 19, 2014 [PCT/ISA/210].

* cited by examiner

SURGE ABSORBING ELEMENT

CROSS REFERENCE TO RELATED APPLICATIONS

This application is a National Stage of International Application No. PCT/JP2014/063743, filed on May 23, 2014, the contents of all of which are incorporated herein by reference in their entirety.

FIELD

The present invention relates to a surge absorbing element that protects an electronic component and a circuit having the electronic component mounted thereon from a surge voltage.

BACKGROUND

A surge absorbing element has a function of causing a surge current to flow to protect a subsequent-stage circuit when a voltage equal to or higher than a predetermined value is applied. The surge absorbing element generally has a structure in which a pair of electrodes is attached to both ends of a varistor substrate made of ZnO or the like, respectively, external leads are drawn from the respective electrodes, and the varistor substrate and the electrodes are covered by an exterior member.

Due to a current flowing in the varistor substrate, an operation start voltage lowers. That is, a flow of a current deteriorates the function of the surge absorbing element and gradually brings the varistor substrate closer to a short-circuit state. Accordingly, when an excessive surge voltage is applied to the varistor substrate many times and the varistor substrate is further deteriorated, the excessive surge voltage finally causes a short-circuit failure.

For example, Patent Literature 1 describes a metal oxide varistor with bimetal, which has such a function that bimetal is incorporated in a metal oxide varistor (a surge absorbing element) for absorbing a surge voltage to be used to protect an electronic component.

CITATION LIST

Patent Literature

Patent Literature 1: Japanese Utility Model Laid-open Publication No. H1-86202

SUMMARY

Technical Problem

In the metal oxide varistor with bimetal described in Patent Literature 1, when a surge voltage equal to or higher than a rated value is applied to the varistor substrate including a metal oxide, the bimetal deforms due to heat generated by the varistor substrate and the surge absorbing element is brought to an open state to block a current flowing in the metal oxide varistor. When the current is blocked, the metal oxide varistor is then naturally cooled. Accordingly, the bimetal returns to its original shape and the surge absorbing element is back to the short-circuit state, so that the function of the surge absorbing element is recovered.

However, the metal oxide varistor with bimetal described in Patent Literature 1 does not prevent deterioration of the varistor substrate itself. Therefore, when the metal oxide varistor is naturally cooled, the bimetal returns to its original shape and the surge absorbing element is back to the short-circuit state. Accordingly, a surge voltage equal to or higher than the rated value may be applied to the metal oxide varistor (the surge absorbing element) to cause a current to flow through repeatedly and a short-circuit failure may occur, which leads to a temperature increase in the metal oxide varistor.

The present invention has an object of suppressing a current from flowing in a surge absorbing element of which a function of absorbing surge is deteriorated.

Solution to Problem

The present relates to a surge absorbing element including: a varistor substrate; a pair of electrodes that are electrically connected to both end faces of the varistor substrate, respectively, to sandwich the varistor substrate; external leads that electrically connect to the paired electrodes, respectively; exterior members that cover the electrodes; and a thermal expansion body that is provided between the paired electrodes and that irreversibly expands with heat generated by the varistor substrate to separate at least one of the paired electrodes from the varistor substrate.

Advantageous Effects of Invention

The present invention can suppress occurrence of a short-circuit failure in a state where a function of a surge absorbing element to absorb surge is deteriorated.

DESCRIPTION OF EMBODIMENTS

Modes for carrying out the present invention (embodiments) will be explained below in detail with reference to the accompanying drawings.

First Embodiment

Figure 1:
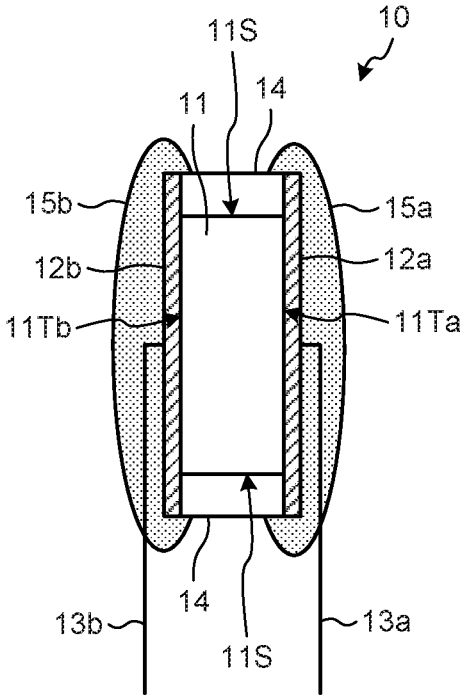
FIG. 1 is a sectional view illustrating a surge absorbing element according to a first embodiment.
Figure 2:
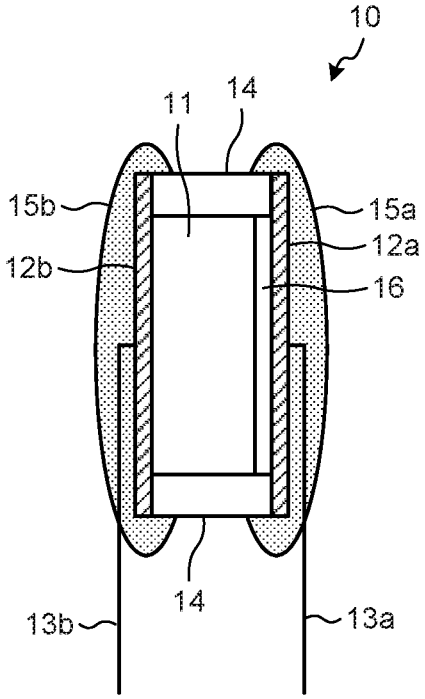
FIG. 2 is a sectional view illustrating an open state of the surge absorbing element according to the first embodiment.

FIG. 1 is a sectional view illustrating a surge absorbing element according to a first embodiment. FIG. 2 is a sectional view illustrating an open state of the surge absorbing element according to the first embodiment.

A surge absorbing element 10 has a function of causing a surge current to flow when a high voltage equal to or higher than a predetermined value is applied, that is, has a surge absorbing function. As illustrated in FIGS. 1 and 2, the surge absorbing element 10 according to the first embodiment includes a varistor substrate 11, a pair of electrodes 12*a* and 12*b*, external leads 13*a* and 13*b*, exterior members 15*a* and 15*b*, and a thermal expansion body 14.

The varistor substrate 11 includes, for example, a metal oxide such as ZnO or $SrTiO_3$. However, a material that can be used for the varistor substrate 11 is not limited to the metal oxides described above. The varistor substrate 11 has a pair of end faces 11Ta and 11Tb and a side part 11S. The paired end faces 11Ta and 11Tb face each other. The side part 11S connects the paired end faces 11Ta and 11Tb to each other.

The paired electrodes 12*a* and 12*b* electrically connect to the both end faces 11Ta and 11Tb of the varistor substrate 11, respectively. Specifically, the electrode 12*a* is electrically connected to the end face 11Ta of the varistor substrate 11 and the electrode 12*b* is electrically connected to the end face 11Tb of the varistor substrate 11. With this structure, the paired electrodes 12*a* and 12*b* hold the varistor substrate 11 to be sandwiched thereby and are not electrically connected to each other.

The external leads 13*a* and 13*b* electrically connect to the paired electrodes 12*a* and 12*b*, respectively. The exterior members 15*a* and 15*b* cover the paired electrodes 12*a* and 12*b*.

The varistor substrate 11 and the electrode 12*b* are bonded, for example, with a conductive adhesive to be electrically connected to each other. The varistor substrate 11 and the electrode 12*a* are separably and electrically connected to each other, for example, with a conductive paste. In the first embodiment, it suffices that at least one set of either the varistor substrate 11 and the electrode 12*b* or the varistor substrate 11 and the electrode 12*a* is separably and electrically connected to each other. Therefore, both the set of the varistor substrate 11 and the electrode 12*b* and the set of the varistor substrate 11 and the electrode 12*a* may be electrically connected to each other, for example, with a conductive paste.

The thermal expansion body 14 is provided on the side part 11S of the varistor substrate 11 to be located between the paired electrodes 12*a* and 12*b* and be sandwiched by the paired electrodes 12*a* and 12*b*. The thermal expansion body 14 irreversibly expands with heat generated by the varistor substrate 11 and separates at least one of the paired electrodes 12*a* and 12*b* from the varistor substrate 11. In the first embodiment, because the electrode 12*b* is bonded to the varistor substrate 11 and the electrode 12*a* is connected to the varistor substrate 11 with the conductive paste or the like, the electrode 12*a* is separated from the varistor substrate 11 due to expansion of the thermal expansion body 14. As described above, the electrode 12*b* may be separated from the varistor substrate 11 or the electrodes 12*a* and 12*b* both may be separated from the varistor substrate 11.

For example, when the varistor substrate 11 is deteriorated and the operation start voltage lowers, resulting in a short-circuit failure state, a large current consequently flows in the varistor substrate 11 and accordingly the varistor substrate 11 generates heat. The heat generated in this way transmits to the thermal expansion body 14, so that the thermal expansion body 14 irreversibly expands (thermally expands) to separate the electrode 12*a* from the varistor substrate 11.

The thermal expansion body 14 is placed so as to be wound around the side part 11S of the varistor substrate 11. The thermal expansion body 14 is bonded to the electrodes 12*a* and 12*b*, for example, with an insulating adhesive. The exterior members 15*a* and 15*b* are, for example, resin and covers the electrodes 12*a* and 12*b* and a part of the thermal expansion body 14. In this manner, in the first embodiment, the exterior members 15*a* and 15*b* cover a part of the thermal expansion body 14 and do not entirely cover the thermal expansion body 14. Therefore, a part of the thermal expansion body 14 not covered by the exterior members 15*a* and 15*b* can be visually recognized from outside of the surge absorbing element 10. Although the thermal expansion body 14 expands with heat in a manner described below, prohibition of the expansion of the thermal expansion body 14 is suppressed because the external members 15*a* and 15*b* do not entirely cover the thermal expansion body 14.

The thermal expansion body 14 is, for example, resin irreversibly expandable with heat. As the resin irreversibly expandable with heat, AF-3024 manufactured by Sumitomo 3M Limited is used, for example. When the thermal expansion body 14 made of resin irreversibly expandable with heat has reached a predetermined temperature, a plurality of gas cavities are formed therein to be in a foamed state and the thermal expansion body 14 expands to increase the outside dimension. Once having the gas cavities formed therein, the thermal expansion body 14 does not decrease in the volume even after cooled. The thermal expansion body 14 is irreversibly expanded in this way. That is, once the thermal expansion body 14 is expanded, it keeps the expanded state.

When the thermal expansion body 14 is irreversibly expanded to increase the outside dimension, the distance between the paired electrodes 12*a* and 12*b* increases. As a result, the thermal expansion body 14 separates the electrode 12*a* from the varistor substrate 11 and forms an insulating gap 16 between the varistor substrate 11 and the electrode 12*a* as illustrated in FIG. 2. When the electrode 12*a* is separated from the varistor substrate 11, the surge absorbing element 10 is brought to an open state and thus no current flows in the varistor substrate 11 even when a voltage is applied to the paired electrodes 12*a* and 12*b*.

When an excessive surge voltage is applied to the varistor substrate 11 many times and an excessive current flows therein many times, the varistor substrate 11 deteriorates to lower the operation start voltage and approaches the short-circuit failure state. That is, the surge absorbing function of the surge absorbing element 10 deteriorates. When the varistor substrate 11 approaches the short-circuit failure state, the operation start voltage lowers. Therefore, in such a case that the surge absorbing element 10 is connected between phases of power supply lines, a current flows in the varistor substrate 11 and heat is generated, resulting in a temperature increase. As a result, the temperature of the surge absorbing element 10, more specifically, of the exterior members 15*a* and 15*b* increases.

The thermal expansion body 14 irreversibly expands with heat generated by the varistor substrate 11 due to a current flowing in the deteriorated varistor substrate 11. Accordingly, once the thermal expansion body 14 is expanded, the surge absorbing element 10 keeps the state in which the insulating gap 16 is formed between the varistor substrate 11 and the electrode 12*a* as illustrated in FIG. 2. Therefore, once the thermal expansion body 14 is expanded, the surge absorbing element 10 keeps the open state. In the surge absorbing element 10, because no current flows in the varistor substrate 11 after the thermal expansion body 14 is expanded, occurrence of a short-circuit failure of power supply lines, a circuit, or devices to which the surge absorbing element 10 is attached can be suppressed in a state where the surge absorbing function is lowered. Furthermore, in the surge absorbing element 10, a temperature increase in the varistor substrate 11 and the exterior members 15*a* and 15*b* in the state where the surge absorbing function is lowered is suppressed.

A temperature at which the thermal expansion body 14 starts irreversible expansion is referred to as an "expansion start temperature". The thermal expansion body 14 irreversibly expands when reaching a temperature equal to or higher than the expansion start temperature (180° C., for example). The expansion start temperature depends on specifications of resin that is irreversibly expandable with heat and thus is not limited to 180° C. described above. For example, the expansion start temperature is preferably equal to or lower than a heat-resisting temperature of the exterior members 15*a* and 15*b* and is preferably about 5° C. to 10° C. lower than the heat-resisting temperature of the exterior members 15*a* and 15*b*. By changing at least one of the specifications of the expandable resin used for the thermal expansion body 14 and specifications of the exterior members 15*a* and 15*b*, the expansion start temperature can be set to be equal to or lower than the heat-resisting temperature of the exterior members 15*a* and 15*b*.

When the surge absorbing function of the surge absorbing element 10 is deteriorated, the thermal expansion body 14 irreversibly expands and the open state on a safe side is kept. As a result, a flow of a current in the surge absorbing element 10 having the deteriorated surge absorbing function is prevented, so that occurrence of a short-circuit failure in the circuit or devices to which the surge absorbing element 10 is attached can be suppressed. It is also possible to suppress a current from continuously flowing in the varistor substrate 11 of the surge absorbing element 10 in a state where the surge absorbing element is deteriorated. As a result, a temperature increase in the surge absorbing element 10 is suppressed and thus the safety is improved. Furthermore, because the thermal expansion body 14 irreversibly expands at a temperature equal to or lower than the heat-resisting temperature of the exterior members 15*a* and 15*b*, the exterior members 15*a* and 15*b* can be used at a temperature equal to or lower than the heat-resisting temperature.

While resin that irreversibly expands with heat is used as the thermal expansion body 14 in the first embodiment, the thermal expansion body 14 is not limited to resin and any material other than resin can be used as long as it irreversibly expands with heat. For example, the thermal expansion body 14 may be shape-memory alloy that deforms so as to increase the distance between the paired electrodes 12*a* and 12*b* when reaching a temperature equal to or higher than the expansion start temperature. Alternatively, the thermal expansion body 14 may be a structure in which a vaporizing material or a material having a large thermal expansion coefficient is enclosed in a container made of a plastic deformable material.

Second Embodiment

Figure 3:
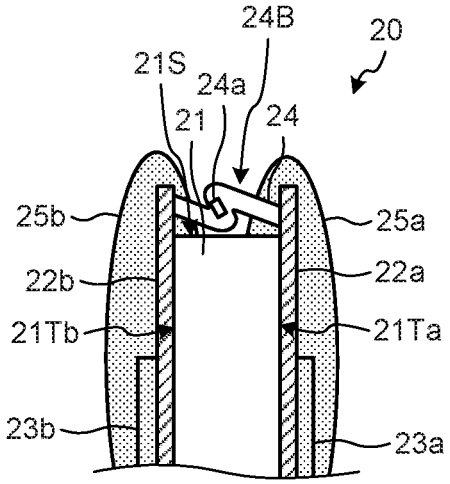
FIG. 3 is a partial sectional view illustrating a surge absorbing element according to a second embodiment.
Figure 4:
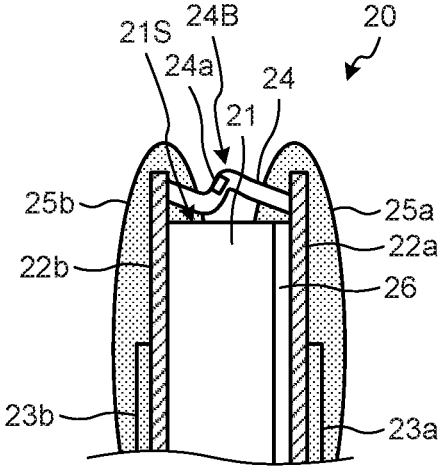
FIG. 4 is a partial sectional view illustrating an open state of the surge absorbing element according to the second embodiment.

FIG. 3 is a partial sectional view illustrating a surge absorbing element according to a second embodiment. FIG. 4 is a partial sectional view illustrating an open state of the surge absorbing element according to the second embodiment.

As illustrated in FIGS. 3 and 4, a surge absorbing element 20 includes a varistor substrate 21, a pair of electrodes 22*a* and 22*b*, external leads 23*a* and 23*b*, and exterior members 25*a* and 25*b*. The varistor substrate 21 has a shape and functions identical to those of the varistor substrate 11 included in the surge absorbing element 10 according to the first embodiment.

The surge absorbing element 20 is different from the surge absorbing element 10 according to the first embodiment in the shape and functions of a thermal expansion body 24. The thermal expansion body 24 is a columnar member and has a bent part 24B between the paired electrodes 22*a* and 22*b*. The bend part 24B is sigmoidally bent. The bend part 24B has a mark 24*a* inside a bent portion that is not viewed from outside of the surge absorbing element 20. The mark 24*a* indicates that the surge absorbing element 20 has been brought to an open state as a result of deterioration of the varistor substrate 21 included in the surge absorbing element 20.

In the second embodiment, the surge absorbing element 20 includes a plurality of the thermal expansion bodies 24. The thermal expansion bodies 24 are sandwiched between the paired electrodes 22*a* and 22*b* and are placed outside a side part 21S of the varistor substrate 21. When the surge absorbing element 20 is viewed in a direction orthogonal to end faces 21Ta and 21Tb of the varistor substrate 21, the thermal expansion bodies 24 are preferably placed at substantially equal intervals, respectively, along a direction in which the side part 21S of the varistor substrate 21 extends. This placement enables the distance between the paired electrodes 22*a* and 22*b* to be uniformly increased when the thermal expansion bodies 24 irreversibly expand. As a result, the electrode 22*a* or 22*b* is reliably separated from the varistor substrate 21.

While the number of the thermal expansion bodies 24 is not limited, it is preferable that the surge absorbing element 20 include at least three thermal expansion bodies 24. This suppresses the electrode 22*a* or 22*b* from being inclined when the thermal expansion bodies 24 irreversibly expand. Accordingly, the electrode 22*a* or 22*b* is reliably separated from the varistor substrate 21 and the surge absorbing element 20 is reliably brought to the open state.

When the varistor substrate 21 is more deteriorated, the operation start voltage lowers and the surge absorbing element 20 approaches the short-circuit failure state. When a current flows in the varistor substrate 21 in this state and the temperature of the thermal expansion bodies 24 becomes equal to or higher than the expansion start temperature, the thermal expansion bodies 24 irreversibly expand and the bent parts 21B become unbent. Due to irreversible expansion of the thermal expansion bodies 24, the electrode 22*a* is separated from the varistor substrate 21 and an insulating gap 26 is formed between the varistor substrate 21 and the electrode 22*a*.

When the bent parts 24B of the thermal expansion bodies 24 become unbent, the marks 24*a* provided inside the bent portions become viewable from outside of the thermal expansion bodies 24. Therefore, the surge absorbing element 20 can inform a user of the open state. The material and the expansion start temperature of the thermal expansion bodies 24 are identical to those of the thermal expansion body 14 described in the first embodiment.

In this manner, the surge absorbing element 20 provides actions and effects identical to those of the surge absorbing element 10 according to the first embodiment. Furthermore, the surge absorbing element 20 can inform the user of the open state and can prompt the user to replace the surge absorbing element 20. Replacement with a new surge absorbing element 20 enables reliable protection of a subsequent-stage circuit from the surge voltage.

Third Embodiment

Figure 5:
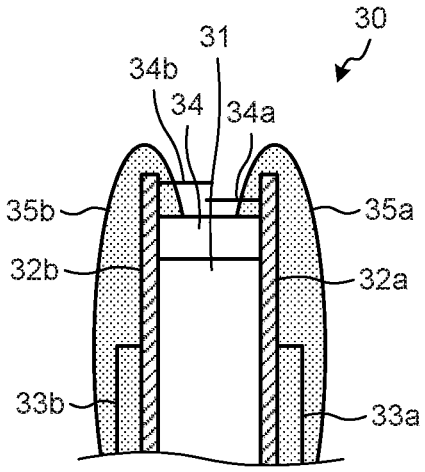
FIG. 5 is a partial sectional view illustrating a surge absorbing element according to a third embodiment.
Figure 6:
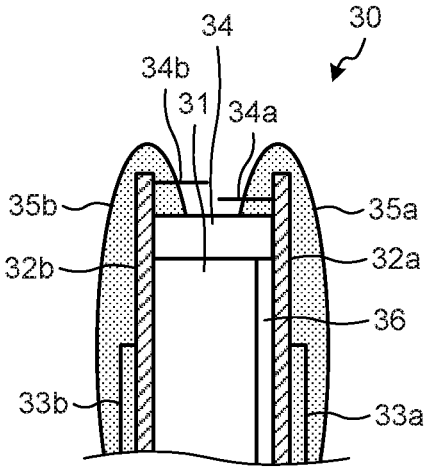
FIG. 6 is a partial sectional view illustrating an open state of the surge absorbing element according to the third embodiment.

FIG. 5 is a partial sectional view illustrating a surge absorbing element according to a third embodiment. FIG. 6 is a partial sectional view illustrating an open state of the surge absorbing element according to the third embodiment.

As illustrated in FIGS. 5 and 6, a surge absorbing element 30 includes a varistor substrate 31, a pair of electrodes 32*a* and 32*b*, external leads 33*a* and 33*b*, exterior members 35*a* and 35*b*, and a thermal expansion body 34. The varistor substrate 31 included in the surge absorbing element 30 has a shape and functions identical to those of the surge absorbing element 10 according to the first embodiment.

The surge absorbing element 30 is different from the surge absorbing element 10 according to the first embodiment in that covers 34*a* and 34*b* that cover the thermal expansion body 34 are attached to the paired electrodes 32*a* and 32*b* or the exterior members 35*a* and 35*b*, respectively.

The covers 34*a* and 34*b* are provided on surfaces of the paired electrodes 32*a* and 32*b* that face each other, respectively. The cover 34*a* is attached to the electrode 32*a* and the cover 34*b* is attached to the electrode 32*b*. For example, the covers 34*a* and 34*b* may be formed by folding the corresponding electrodes 32*a* and 32*b* to be integral with the electrodes 32*a* and 32*b*, respectively, or may be attached to the corresponding electrodes 32*a* and 32*b* as separate members from the electrodes 32*a* and 32*b*, respectively. Alternatively, the covers 34*a* and 34*b* may be attached to the exterior members 35*a* and 35*b*, respectively.

The covers 34*a* and 34*b* are provided outside the thermal expansion body 34 that is sandwiched between the paired electrodes 32*a* and 32*b*. As illustrated in FIG. 5, the covers 34*a* and 34*b* overlap with each other at end parts on the opposite side from parts that are attached to the electrodes 32*a* and 32*b*. With this structure, the covers 34*a* and 34*b* cover the thermal expansion body 34. The covers 34*a* and 34*b* are configured to be spaced at the end parts on the opposite side from the parts that are attached to the electrodes 32*a* and 32*b* when the thermal expansion body 34 irreversibly expands and the distance between the paired electrodes 32*a* and 32*b* is increased.

When the varistor substrate 31 is more deteriorated, the operation start voltage lowers and the surge absorbing element 30 approaches the short-circuit failure state. When a current flows in the varistor substrate 31 in this state and the temperature of the thermal expansion body 34 becomes equal to or higher than the expansion start temperature, the thermal expansion body 34 irreversibly expands. Irreversible expansion of the thermal expansion body 34 separates the electrode 32*a* from the varistor substrate 31 and forms an insulating gap 36 between the varistor substrate 31 and the electrode 32*a*.

When the thermal expansion body 34 expands, the covers 34*a* and 34*b* are spaced, so that the thermal expansion body 34 can be viewed from outside. Therefore, the surge absorbing element 30 can inform a user of the open state. The material and the expansion start temperature of the thermal expansion body 34 are identical to those of the thermal expansion body 14 described in the first embodiment.

In this manner, the surge absorbing element 30 provides actions and effects identical to those of the surge absorbing element 10 according to the first embodiment. Furthermore, the surge absorbing element 30 can inform the user that the surge absorbing element 30 has been brought to the open state and can prompt the user to replace the surge absorbing element 30. Replacement with a new surge absorbing element 30 enables a subsequent-stage circuit to be reliably protected from the surge voltage.

It is preferable that the thermal expansion body 34 on the side of the covers 34*a* and 34*b* have a different color from that of at least either the covers 34*a* and 34*b* or the exterior members 35*a* and 35*b*. This enables a user to easily visually recognize the thermal expansion body 34 when the covers 34*a* and 34*b* are spaced because the thermal expansion body 34 has a different color from that of at least either the covers 34*a* and 34*b* or the exterior members 35*a* and 35*b*. As a result, the surge absorbing element 30 can reliably inform the user that the surge absorbing element 30 has been brought into the open state.

As a method of informing the user that the surge absorbing element 10 according to the first embodiment has been brought into the open state, for example, paint that changes color when reaching a temperature equal to or higher than the expansion start temperature is coated on an outer surface of the thermal expansion body 14 or a material that changes color when reaching a temperature equal to or higher than the expansion start temperature is used for the thermal expansion body 14.

Alternatively, a user may be informed that the surge absorbing element 10 has been brought into the open state by provision of a sensor that detects expansion of the thermal expansion body 14 according to the first embodiment with heat, and an alarm unit that issues an alarm based on an output from the sensor upon detection of expansion of the thermal expansion body 14 with heat, for example, on a circuit at a subsequent stage of the surge absorbing element 10. The sensor that detects expansion of the thermal expansion body 14 is, for example, a sensor detecting the length of the thermal expansion body 14 or a temperature sensor detecting that the temperature of the thermal expansion body 14 has reached a temperature equal to or higher than the expansion start temperature. The alarm unit may be, for example, an alarm unit that emits at least one of light and sound when the sensor has detected expansion of the thermal expansion body 14.

While the first to third embodiments have been described above, the first to third embodiments are not limited to the contents described above. Furthermore, the constituent elements described above include those that can be easily anticipated by persons skilled in the art, that are substantially identical, or that are in the range of so-called equivalents. Further, the constituent elements described above can be combined with each other as appropriate. In addition, at least any one of various types of omission, replacement, and modification of the constituent elements can be made without departing from the scope of the first to third embodiments.

REFERENCE SIGNS LIST

10, 20, 30 surge absorbing element, 11, 21, 31 varistor substrate, 12*a*, 12*b*, 22*a*, 22*b*, 32*a*, 32*b* electrode, 13*a*, 13*b*, 23*a*, 23*b*, 33*a*, 33*b* external lead, 14, 24, 34 thermal expansion body, 24*a* failure indication mark, 34*a*, 34*b* cover, 15*a*, 15*b*, 25*a*, 25*b*, 35*a*, 35*b* exterior member.

The invention claimed is:

1. A surge absorber comprising:

a varistor substrate;

a pair of electrodes that are electrically connected to both end faces of the varistor substrate, respectively, to sandwich the varistor substrate;

external wirings that electrically connect to the paired electrodes, respectively;

exterior coverings that cover the electrodes; and a thermal expander that is provided between the paired electrodes and that irreversibly expands with heat produced by the varistor substrate to separate at least one of the paired electrodes from the varistor substrate, wherein the thermal expander is configured to keep an expanded state even after cooled and to enable a mark provided in the thermal expander to be viewable from outside of the thermal expander when the thermal expander expands.

2. The surge absorber according to claim 1, comprising covers that are provided on the paired electrodes or the exterior coverings, respectively, to cover the thermal expander, wherein the covers are spaced to enable the thermal expander to be visually recognized when the thermal expander irreversibly expands with heat.

3. The surge absorber according to claim 1, comprising:

a sensor that detects irreversible expansion of the thermal expander with heat; and an alarm that issues an alarm based on an output from the sensor at a time when the sensor has detected the expansion with heat.

4. The surge absorber according to claim 1, wherein a temperature at which the thermal expander starts expanding is equal to or higher than 180° C.

5. A surge absorber comprising:

a varistor substrate;

a pair of electrodes that are electrically connected to both end faces of the varistor substrate, respectively, to sandwich the varistor substrate;

external wirings that electrically connect to the paired electrodes, respectively;

exterior coverings that cover the electrodes; and a thermal expander that is provided between the paired electrodes and that irreversibly expands with heat produced by the varistor substrate to separate at least one of the paired electrodes from the varistor substrate, wherein paint that changes a color of the thermal expander when the thermal expander has reached a temperature at which the thermal expander irreversibly expands is coated on a surface of the thermal expander.

6. The surge absorber according to claim 5, comprising covers that are provided on the paired electrodes or the exterior coverings, respectively, to cover the thermal expander, wherein the covers are spaced to enable the thermal expander to be visually recognized when the thermal expander irreversibly expands with heat.

7. The surge absorber according to claim 5, comprising:

a sensor that detects irreversible expansion of the thermal expander with heat; and an alarm that issues an alarm based on an output from the sensor at a time when the sensor has detected the expansion with heat.

8. The surge absorber according to claim 5, wherein a temperature at which the thermal expander starts expanding is equal to or higher than 180° C.

* * * * *